United States Patent [19]

Parise

[11] 4,234,995

[45] Nov. 25, 1980

[54] POWER SCRUBBER WITH PIVOTABLY MOUNTED RECOVERY HEAD

[75] Inventor: Carl Parise, Reno, Nev.

[73] Assignee: Parise & Sons, Inc., Sparks, Nev.

[21] Appl. No.: 55,669

[22] Filed: Jul. 9, 1979

[51] Int. Cl.[3] ..... A47L 7/00

[52] U.S. Cl. ..... 15/322; 15/359

[58] Field of Search ..... 15/321, 322, 354, 359, 15/320

[56] References Cited

U.S. PATENT DOCUMENTS

| | | | |
|---|---|---|---|
| 3,402,420 | 9/1968 | Schaeffer | 15/320 |
| 3,699,607 | 10/1972 | Putt | 15/320 |
| 4,146,944 | 4/1979 | Pinto | 15/321 |
| 4,167,799 | 9/1979 | Webb | 15/322 X |

*Primary Examiner*—Christopher K. Moore

*Attorney, Agent, or Firm*—Sughrue, Rothwell, Mion, Zinn and Macpeak

[57] ABSTRACT

A power brush housing assembly formed by a wheeled chassis with a housing overlying the chassis and fixed thereto bears transversely, an elongated scrubbing brush roller, and a motor for driving the brush roller to scrub the surface traversed by the power scrubber. A triangular shaped vacuum recovery head is hinge mounted to the face of the housing to permit tilting of the head from its normal vertical orientation to an inclined orientation and to effect movement of the mouth of the vacuum recovery head away from the surface being scrubbed to permit the power scrubber to move over minor obstructions.

2 Claims, 3 Drawing Figures

POWER SCRUBBER WITH PIVOTABLY MOUNTED RECOVERY HEAD

FIELD OF THE INVENTION

This invention relates to hot water vacuum extraction cleaning machines and, more particularly, to an improved power scrubber and vacuum recovery head.

BACKGROUND OF THE INVENTION

Small size commercial and home cleaning machines of the hot water, vacuum extraction type, have come into vogue within the last few years, permitting the housewife to use either her own machine or to rent such machine from a hardware store or the like and effect wet cleaning of wall-to-wall carpeting and the like and in effective and thorough manner previously unobtainable except by expensive, large size commercial equipment.

Such hot water vacuum extraction cleaners are the subject matter of my earlier U.S. Pat. No. 3,896,521 issuing July 29, 1975, and entitled "Home Cleaning System".

The hot water, vacuum extraction cleaner of the referred to patent comprises a modified rectangular body mounted on wheels for manual movement over the surface being cleaned and bearing side by side upright tanks, the first of which holds the cleaning liquid which is heated by a suitable heater and which is connected by means of a hose and pump to a hot water spray nozzle fixed to a generally V-shaped vacuum recovery head. The head forms a V-shaped chamber whose apex side is remote from the surface being cleaned and which opens to the interior of a tubular wand comprising both a handle and a return flow path for the dirty liquid which is sucked from the floor by application of vacuum pressure through the wand and to the V-shaped chamber of the vacuum recovery head. The vacuum recovery head is open on its lower side, that is, remote from the apex portion of the recovery head, thereby defining a narrow elongated rectangular mouth which is maintained in contact with the floor, carpeting or other surface being cleaned. The operator, by forcibly propelling the wand, causes the vacuum recovery head to traverse the surface being cleaned. The nozzle is fixed to the side of the recovery head and sprays hot cleaning liquid or water against the surface being cleaned and adjacent the elongated mouth of the recovery head. The air and dirty water returning through the wand after pick up by the vacuum recovery head is discharged into the second of the two tanks within the cleaner body, the second tank known as the "dump tank" and being readily removable from the body such that, after accumulation of the dirty liquid therein, it may be readily dumped. The air is separated from the air and water return within the dump tank, and the tank is maintained under vacuum pressure by connection through a tank riser tube to the vacuum blower or pump mounted within the body and beneath the "dump tank".

While such vacuum hot water extraction cleaning systems, as set forth in the patent, have worked quite satisfactorily, it has been determined that a more effective removal of dirt, particularly from a surface where the dirt is highly entrained, as for instance in wall to wall carpeting is achieved if there is a beating or forced brushing of that surface being cleaned adjacent the point of impact of the hot water or heated cleaning liquid. This need has lead to the development of a power scrubber in the form of an assembly including a horizontally oriented, elongated scrubbing brush roller mounted within a housing with the periphery of the brush roller in contact with the surface being scrubbed, and with the vacuum recovery head and the heated liquid cleaner or hot water spray nozzle incorporated within the assembly. Such a power scrubber is the subject matter of my U.S. application Ser. No. D-897,607 filed Apr. 18, 1978.

In the power scrubber of the above identified design application the vacuum recovery head is essentially identical to that of my earlier U.S. Pat. No. 3,896,521. However, instead of that vacuum recovery head, supporting the heated liquid or hot water spray nozzle, the nozzle is mounted to a wheeled chassis remote from the location of the vacuum recovery head and in fact adjacent the rear face of the power brush housing, with the vacuum extraction head fixed to the chassis and being positioned and extending along the front of the power brush housing.

While this assembly provides the beating or powered brush application to the localized area of the surface being scrubbed, such as the wall to wall carpeting, all of the elements are fixedly mounted to the chassis, and the elements are maintained in constant height relation to the surface being scrubbed such that if an obstruction is encountered or where for one reason or another, the plane of vacuum application to the surface being scrubbed needs to be shifted vertically or possibly inclined, as defined by the mouth of the vacuum recovery head, the fixed nature of the assembly set forth in the above identified design application precludes in some cases effective use of the power scrubber.

It is therefore a primary object of the present invention to provide an improved power scrubber in which the vacuum recovery head has some flexibility in terms of its position relative to the scrubbing brush roller such that the presence of the vacuum recovery head does not unduly restrict applications of use of the power scrubber.

It is a further object of the present invention to provide an improved power scrubber in which the vacuum recovery head is pivotably mounted to the scrubber powered brush housing to permit selectively, the recovery head to be pivoted and thereby raise the mouth of the recovery head to meet variations in the continuity of the surface being scrubbed.

SUMMARY OF THE INVENTION

The present invention is directed to an improved power scrubber having a pivotably mounted vacuum recovery head. The invention involves a powered brush housing assembly comprising a wheeled chassis, a housing overlying the chassis and fixed thereto, an elongated scrubbing brush roller mounted to the bottom of the chassis for rotation about a horizontal axis with the periphery of the brush in contact with the underlying surface to be scrubbed. A motor carried by the chassis is operatively coupled to the brush roller for positively driving the brush roller about its axis to impart a scrubbing action to the surface. A nozzle mounted to the chassis sprays a heated cleaning liquid onto the surface along one face and to one side of the scrubbing brush roller. A vacuum recovery head mounted to the chassis and having an elongated mouth opening to the surface extends parallel to the axis of the roller and to one side thereof. Application of vacuum pressure to the interior of the vacuum recovery head causes water and dirt to be sucked from the surface adjacent the area contacted by the scrubbing brush roller. The improvement comprises means for hinge mounting of the vacuum recovery head to the housing such that the head can be tilted away from the surface being cleaned and to permit the chassis and the vacuum recovery head to move over minor obstructions along the surface being scrubbed.

Preferably, the housing comprises a front wall inclined to the vertical and hinge means including a first elongated hinge plate mounted to the inclined wall and a second elongated hinge plate mounted to a flat sidewall of the head. Thus, the head can be readily pivoted from a vertical orientation wherein the mouth opens directly and at right angles to the surface being cleaned and is positioned immediately adjacent thereto to an inclined position with the head side parallel with the inclined wall of the power brush housing, the mouth raised appreciably above the underlying surface being cleaned and tilted with respect thereto.

Preferably, the vacuum recovery head is triangular in configuration, being formed of laterally spaced planar members, one edge of the triangular shaped head extending parallel to the surface being cleaned and spaced slightly therefrom with that side of the head being open and defining the mouth. The power brush housing inclined wall terminates at its lower face in a vertical portion, and wherein the one hinge plate comprises an elongated plate of a length generally corresponding to that of the head and being fixed to the housing inclined wall above the vertical terminal wall portion of the housing wall. The second hinge plate is fixed to the side of the triangular shaped head adjacent the edge defining the vacuum recovery head mouth, such that the vacuum recovery head is tiltable between a first vertical position where the head is parallel to and adjacent the vertical terminal portion of the housing wall vertical terminal wall and a second position wherein the portion of the triangular vacuum recovery head above the second hinge plate fixed thereto tends to take the same inclination as the inclined wall and is spaced slightly therefrom.

DESCRIPTION OF THE PREFERRED EMBODIMENT

Figure 1:
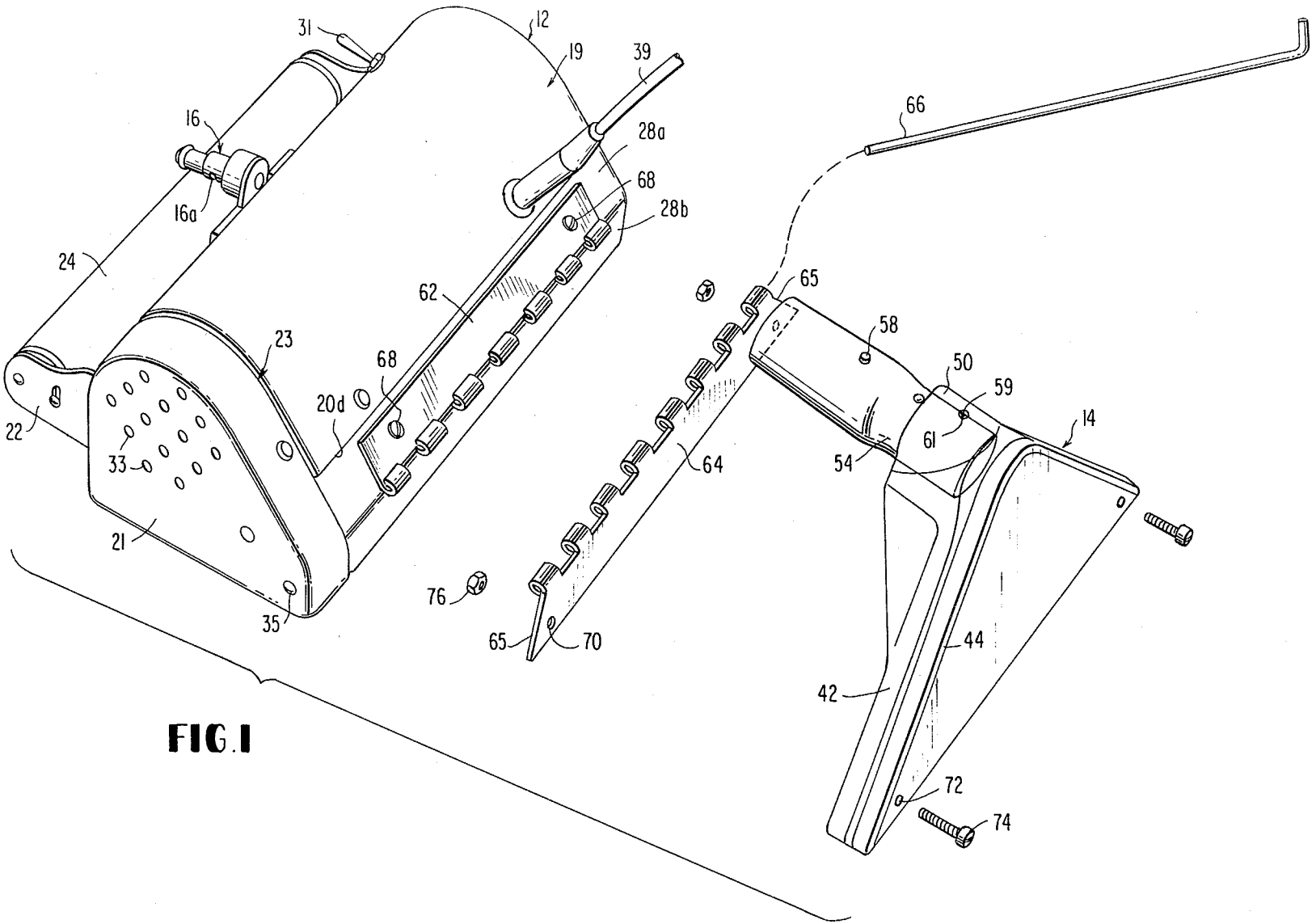
FIG. 1 is an exploded perspective view of the improved power scrubber of the present invention in a preferred form.

Referring to the drawings, there is shown an improved power scrubber indicated generally at 10 which comprises as principal components, a power brush housing assembly 12, a vacuum recovery head 14, and a liquid spray nozzle assembly indicated generally at 16 and borne by the housing assembly 12. As may be perhaps better viewed in FIG. 2, the power brush housing assembly 12 includes a chassis indicated generally at 18, which chassis is formed principally of laterally opposed plates 22 which project forwardly from and are fixed to an elongated, open bottom housing indicated generally at 19. Housing 19 includes two sections 20 and 28. Section 20 is formed of a vertical rear wall portion **20*a*, a curved or domed top wall portion 20*b*, and terminates in an inclined front wall portion 20*c*. The wall portion 20*c* terminates with its lower end 20*d* somewhat above the level of the surface 40 upon which the unit rests and which is subject to a scrubbing or cleaning action. The brush housing wall 28 includes a lower vertical portion 28*b* which is integral with an upper, inclined wall portion 28*a* which terminates in an offset portion 28*c* which underlies the lower end of the inclined front wall portion 20*c*. The housing 19 bears end walls 21, with one end further defined by a cover 23 which is perforated at 33 and which is mounted to the chassis by way of suitable screws as at 35**.

Internally of the housing 19, there is provided an elongated scrubber brush indicated generally at 34 consisting of a shaft or rod 38 which is mounted for rotation at its end within housing 19 between laterally opposed sidewalls 21. The shaft 35 bears radially bristles 36 which are of a given length such that the periphery 38 of the brush roller 34 makes pressure contact with the carpet or other surface being cleaned, the bristles 36 extending below the lower edge 32 of housing 19. The brush is driven by a motor (not shown) housed beneath the dome portion **20*b* of housing 20 and being powered from an electrical source associated with the portion of the machine bearing the dump bucket etc., and connected thereto by means of the electrical lead 39**.

Access to the interior of the housing 20 may be had by the removal of the end cover 23 and by separation of housing 19 wall components 20, 28.

The chassis side plates 22 bear at their forward end, a rubber roller as at 26 mounted transversely for rotation about a horizontal axis on a shaft 24 extending between the side plates with the roller 26 being in contact with surface 40 being cleaned. In order to loosen and effect a deep cleaning of the carpet pile, for instance, where the surface 40 comprises a carpet or rug, the scrubber of the present invention employs the liquid spray nozzle 16 centered to the unit and mounted on the rear wall portion 20 of housing 19 just ahead of roller 26. The nozzle 16 includes a nozzle opening **16*a* permitting the spray pattern to be downward and laterally between the side plates 22** of the assembly.

In similar fashion to U.S. Pat. No. 3,896,521 and the pending design application Ser. No. 897,607, the assembly incorporates a vacuum recovery head, basically constructed in the manner of the vacuum heads of these two references. In that respect, the vacuum recovery head 14 is of triangular shape, comprised of laterally spaced triangular shaped plates as at 42, 44. Plate 42 is preferably opaque and plate 44 is transparent and the plates are separated slightly to form a vacuum chamber 40. Two sides of the triangular shaped chamber are sealed, as for instance by an integral flange **42*a* which overlies and edge of the transparent plate or panel 44. The third side or bottom edge of the triangular shaped head is open defining an elongated rectangular throat as at 48 which faces the surface 40 being cleaned. At the upper apex of the triangular shaped head, the plates or panels 42 and 44 merge into a cylindrical or tubular sleeve 50 which is in open communication with chamber 40. The sleeve bears a circular bore as at 52 which receives one end of a hollow tubular connector 54, the tubular connector 54 being formed of sheet metal or the like and bears pins 58, 59, which project radially outward of the upper surface thereof intermediate of the ends. The tubular connector 54 is sized so as to be slightly smaller in terms of its outside diameter than the inside diameter of a wand 56 within which a portion of the connector 54 is telescopingly inserted, FIG. 2. The wand 56 is provided with a small diameter opening or hole as at 56***a* through which the pin 58 projects, forming a mechanical lock connection between the wand and the connector 54. Further, the connector 54 carries the second pin 59 for projection through an opening or hole 61 within the tubular portion 50 of the head 14. The application of suction pressure to wand 56 permits vacuum pressure within the chamber 46 to produce a suction action at throat 48 opening to the surface 40 being cleaned. Any water, dirt on or about surface 40 is then sucked into the interior of the vacuum recovery head 14, concentrating because of the narrowing chamber at the apex and passing into the lower end of wand 56 through connector 54.

Contrary to the design application referred to above, the head 14 is not fixed in vertical orientation and at a predetermined height relative to the chassis 18 of the scrubber. Preferably, the head is hinge coupled to the housing 20 by means of a hinge indicated generally at 60. The hinge 60 comprises a first elongated hinge plate 62 of rectangular plan configuration which extends almost the complete length of the housing 20 and which is mounted to the upper inclined portion 28*a* of the housing front wall 28. A pair of bolts 68 protrude through the hinge plate 62 at opposite ends and through holes 69 formed within the front wall portion 28*a*. Nuts as at 71 are threaded to the bolts to lock the hinge plate 62 to the face of the housing 20. A second hinge plate 64 is fixedly mounted to the side of the vacuum recovery head panel or plate 42 just above mouth 48. In this respect, holes 72 are drilled through both plates 42 and 44 and bolts 74 project through these holes 72 as well as holes 70 formed within the hinge plate 64, the bolts bearing nuts as at 76 for locking the hinge plate 64 to the side of the vacuum recovery head panel 42. The hinge plate 64 is of trapezoidal configuration having inclined edges 65 of opposite inclination on respective ends and being of a width equal to that of panel 42 at the point where the hinges are bolted to the recovery head. An L-shaped hinge pin or rod 66 completes the hinge connection between plates 62 and 64.

Figure 2:
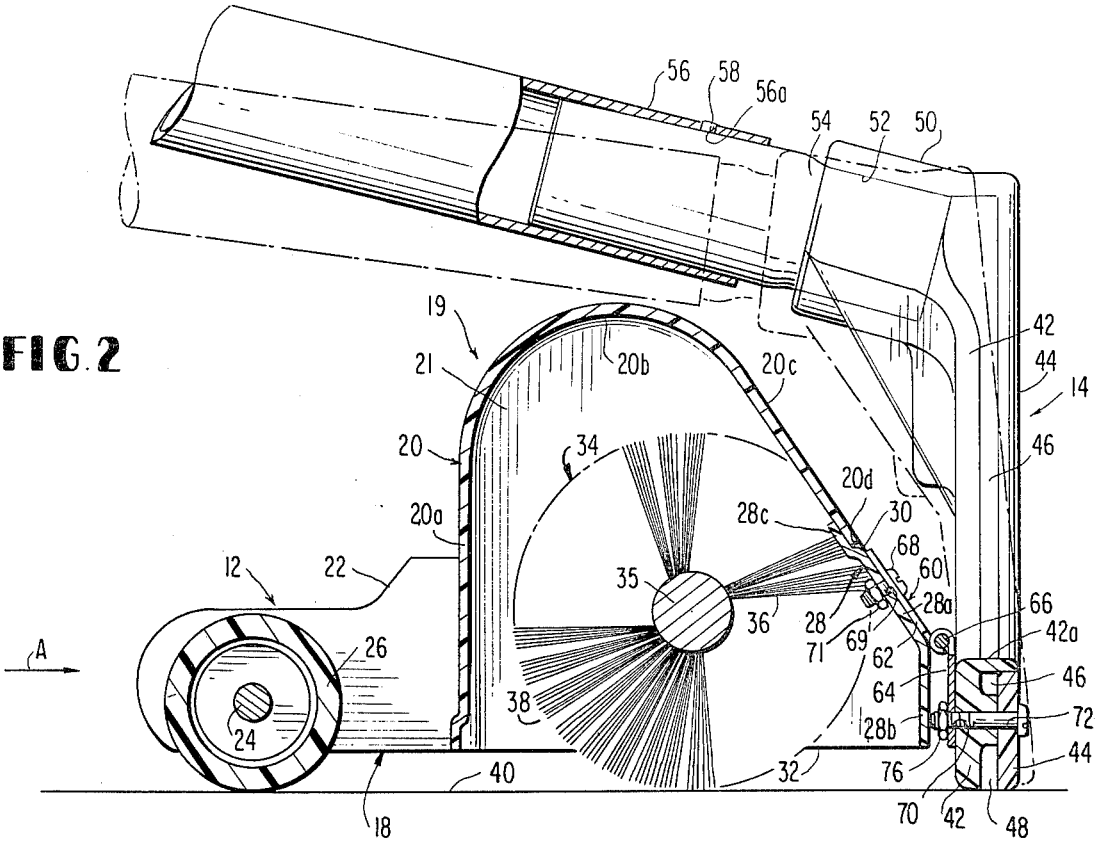
FIG. 2 is a vertical section view of the power scrubber of FIG. 1.
Figure 3:
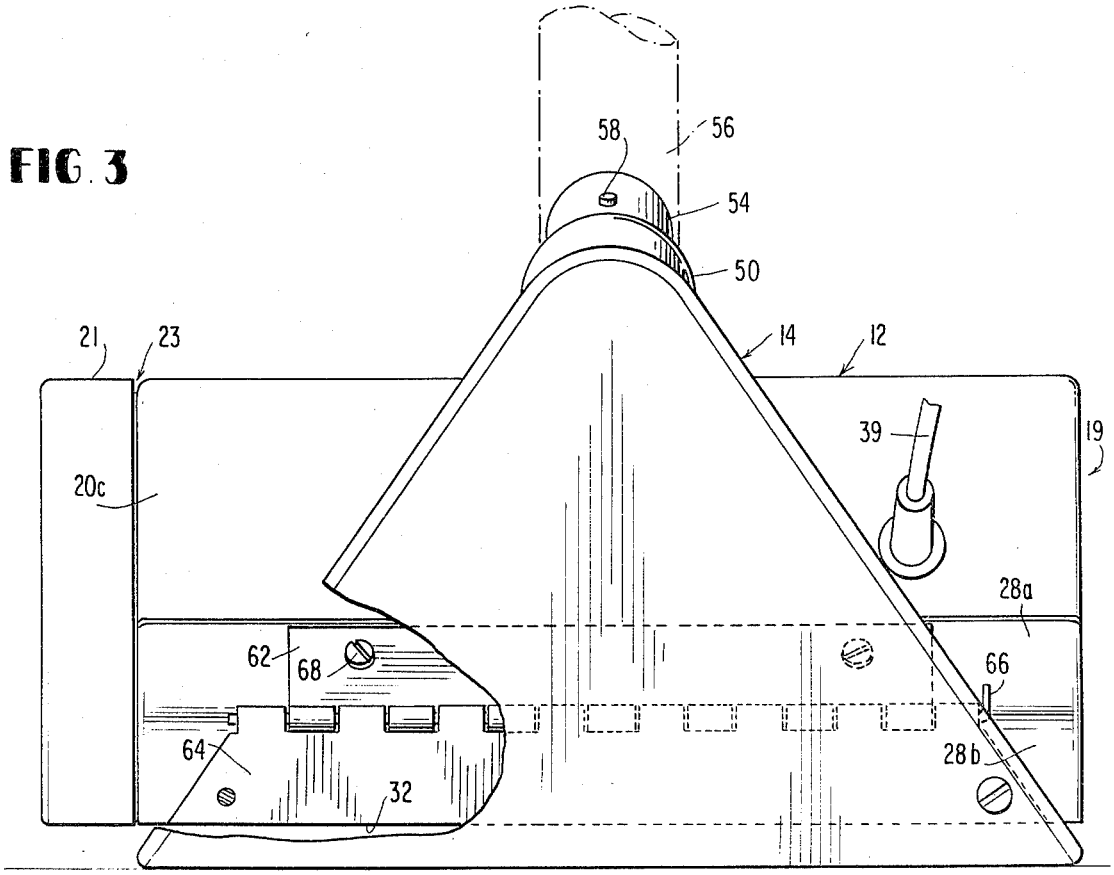
FIG. 3 is a front plan view of the power scrubber of FIGS. 1 and 2, partially broken away.

As may be appreciated, because of the inclination of the front wall portion 20*c* of housing section 20, and the upper inclined portion 28*a* of housing front wall 28, it is possible for the vacuum recovery head to be tilted from its normal vertical orientation as shown in full line, FIG. 2, to at least the dotted line inclined position of the same figure. The tilting is restricted in the illustrated embodiment by the angulation given to the cylindrical or tubular portion 50 of the vacuum recovery head 14. Preferably, the wand intersects the plane of the vacuum chamber 46 almost at right angles, although this is not possible for a head which is mounted to and forms a part of a power scrubber, unless, unlike the illustrated embodiment, the triangular head rises considerably above housing 20.

It may be seen from the dotted line position of the vacuum recovery head 14, FIG. 2, the mouth 48 of the vacuum chamber 46 shifts not only angularly, but also rises relative to the surface 40 being scrubbed. This permits a greater or less vacuum pressure to be exerted on this surface and permits the head and other components of the scrubber to ride over slight surface irregularities encountered during movement of the unit over the surface being scrubbed as for instance in the direction of arrow A, FIG. 2.

While the invention has been particularly shown and described with reference to a preferred embodiment thereof, it will be understood by those skilled in the art that various changes in form and details may be made therein without departing from the spirit and scope of the invention.

What is claimed is:

1. A power brush housing assembly for a hot water vacuum extraction cleaning machine, said assembly comprising a wheeled chassis, a housing overlying said chassis and being fixed thereto, an elongated scrubbing brush roller mounted transversely to the bottom of the chassis and within said housing for rotation about a horizontal axis with its periphery contacting an underlying surface, a motor carried by the chassis and operatively coupled to the brush roller for positively driving said brush roller about its axis to impart a scrubbing action to said surface, a nozzle mounted to said chassis to one side of said brush roller for spraying a hot liquid cleaning solution onto said surface, an elongated, hollow vacuum recovery head mounted to said chassis and extending parallel to said roller and to one side thereof and having one edge bearing a suction opening defining a mouth facing said surface such that the application of vacuum pressure to said head causes water and dirt scrubbed from said surface to be sucked through said mouth into said vacuum head, the improvement comprising: said housing including a wall extending parallel to the axis of said elongated scrubbing brush roller, said wall being inclined to the vertical, means for hinge mounting said vacuum recovery head to said housing, said hinge mounting means comprising a first elongated hinge plate mounted to said inclined housing wall and extending transversely from one end of said housing to the other, a second hinge plate mounted to the side of said vacuum recovery head adjacent the edge opening towards said surface and extending parallel to said edge; whereby, said head can be tilted to deflect the vacuum recovery head from a first position in general vertical orientation to a second position inclined to the vertical towards said inclined housing wall to permit variation in suction pressure and to permit said head to ride over minor obstructions encountered by said assembly during movement across said surface being cleaned.

2. The assembly of claim 1, wherein said vacuum recovery head comprises a pair of laterally spaced plates of generally triangular configuration defining a suction chamber, having one edge parallel to the plane of the surface being cleaned and being sealed about its edges except for said edge facing said surface being cleaned, and wherein said inclined housing wall terminates at its lower end in a vertical portion immediately above the surface being cleaned, and wherein said first hinge plate is mounted to said inclined wall, above said vertical portion, and said second plate is fixed to one of said triangular plates at the side of said recovery head above said suction opening such that said hinge permits said planar vacuum recovery head to be vertically oriented under normal conditions and to be maintained in close confrontation with said vertical terminal wall portion of said housing, and wherein upon tilting of said vacuum recovery head, the portion of said generally planar vacuum recovery head above the hinge plate fixed thereto moves into close proximity and general alignment with the inclined housing wall bearing said one hinge plate.

* * * * *